United States Patent [19]

Alticosalian

[11] Patent Number: 4,549,674

[45] Date of Patent: Oct. 29, 1985

[54] PERFUME DISPENSER

[76] Inventor: Girair H. Alticosalian, 27, Beaufort Rd., Ealing, London, W.5, England

[21] Appl. No.: 472,622

[22] Filed: Mar. 7, 1983

[30] Foreign Application Priority Data

Mar. 9, 1982 [GB] United Kingdom ..... 8206891

[51] Int. Cl.[4] ..... B67D 5/22; B67D 5/52; B67D 83/00; B65D 83/00

[52] U.S. Cl. ..... 222/48; 222/135; 222/144.5; 222/145; 222/336; 222/182; 222/402.13; 222/402.17; 222/514

[58] Field of Search ..... 222/42, 144.5, 145, 222/402.13, 135, 527, 513, 514, 48, 553, 336, 402.1, 402.11, 402.17, 182; 239/304, 337

[56] References Cited

U.S. PATENT DOCUMENTS

| | | | |
|---|---|---|---|
| 2,966,286 | 12/1960 | Moran | 22/553 |
| 2,981,446 | 4/1961 | Campbell | 222/402.13 |
| 3,211,343 | 10/1965 | Silver | 222/145.5 |
| 4,006,841 | 2/1977 | Alticosalian | 222/42 |

*Primary Examiner*—F. J. Bartuska
*Assistant Examiner*—Andrew Jones
*Attorney, Agent, or Firm*—Brisebois & Kruger

[57] ABSTRACT

A perfume dispenser has compartments for separately storing a plurality of liquid perfumes each of a different fragrance, a selector device which enables any one liquid perfume or any combination of liquid perfumes to be selected for dispensing through an outlet of the dispenser and an actuating device operable to cause the release of a quantity of the selected liquid perfume or perfumes into a mixing chamber and from the chamber to said outlet. The actuating device includes a depressable cap which carries an outlet nozzle through which the selected perfume or combination of perfumers may be dispensed and a tubular member of resilient material is provided to conduct the selected perfume or combination of perfumes to the outlet nozzle this tubular member also providing a resilient force against which the cap is depressed when it is desired to actuate the dispenser to dispense the selected perfume or mixture of perfumes from the outlet nozzle.

6 Claims, 5 Drawing Figures

PERFUME DISPENSER

The present invention relates to a perfume dispenser and more particularly to a perfume dispenser which enables any of a plurality of different liquid perfumes to be selected or to be selectively mixed prior to being dispensed, whereby a plurality of different perfume fragrances can be obtained from the dispenser, as desired.

BACKGROUND OF THE INVENTION

One such form of perfume dispenser is disclosed in my U.S. Pat. No. 4,006,841 and comprises a holder for holding a plurality of perfume containers each containing a liquid perfume of a different fragrance, a selector device which, when the plurality of containers are located in the holder, enables liquid perfume from any one or from a combination or combinations of the containers to be selected for dispensing through an outlet of the dispenser and an actuating means operable to cause the release of a quantity of the selected liquid perfume or perfumes into a mixing chamber and from said chamber to said outlet.

The present invention relates to a perfume dispenser in which the necessity for separate perfume containers removably attached to the dispenser is avoided and which may therefore be made as a more compact and integrated assembly.

SUMMARY OF THE INVENTION

According to the invention, the perfume dispenser includes a depressable cap which carries an outlet nozzle through which a selected perfume may be dispensed and a tubular member of resilient material is provided to conduct the selected perfume essence or mixture of essence to the outlet nozzle, said tubular member also providing the resilient force against which the cap is depressed when it is desired to actuate the dispenser to dispense a perfume from the outlet nozzle.

The liquid perfume essences may be under pressure within each compartment forming a liquid container or alternatively the assembly may be of the type in which the liquid perfume essence in each compartment forming a container is only pressurised when its outlet valve is depressed to dispense a quantity of the perfume essence contained therein.

BRIEF DESCRIPTION OF THE DRAWINGS

The invention will now be further described, by way of example, with reference to the accompanying drawings, in which.

DESCRIPTION OF THE PREFERRED EMBODIMENT

Figure 1A:
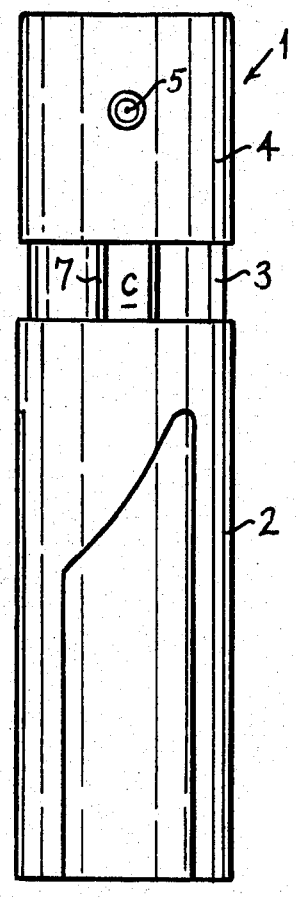
FIGS. 1*a* and 1*b* are views of one embodiment of perfume dispenser according to the invention taken respectively from opposite sides.
Figure 1B:
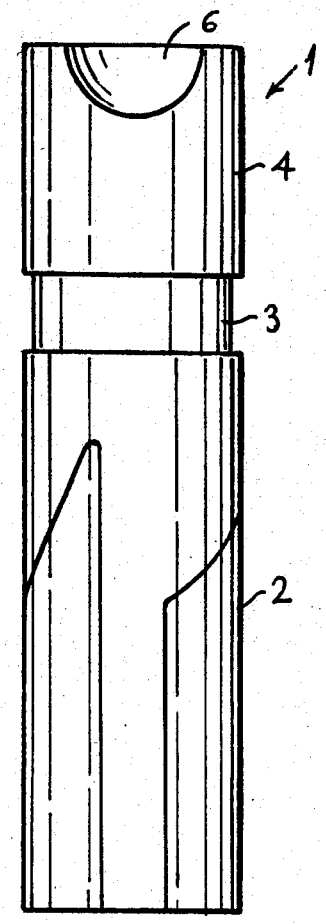

Referring to the drawings and as seen particularly in FIGS. 1*a* and 1*b*, a perfume dispenser generally indicated at 1, comprises a body 2, a mid-part 3 and a cap assembly 4. The body 2 has a plurality of internal longitudinal compartments, each forming a perfume container for containing a different liquid perfume essence under pressure and which are each provided with a pressure-operated outlet valve leading to a mixing chamber disposed in the mid-part 3. The outlet from the mixing chamber leads to an outlet nozzle 5 mounted in the cap assembly 4. This cap assembly is both rotatable and resiliently depressable and to this end is provided with a finger engaging recess 6 in its upper part by means of which the cap may be readily depressed to cause actuation of the pressure-operated valves of one or more of the perfume containers. An inner skirt of the cap 4 carries markings, such as a series of letters A to G which can selectively be made visible through an aperture 7 in the mid-part 3 by rotation of the cap 4. Each letter indicates a different perfume essence or combination of mixed essences, and hence a different fragrance available for dispensing from the outlet nozzle 5.

Thus, if the body 2 has three perfume containers each containing liquid perfume essence under pressure and it is arranged to dispense any of these singly or in any possible combination, it is possible to select up to seven different fragrances, as represented by the different letters A to G, by appropriate rotation of the cap 4 which thus forms a selector device. The cap is then depressed to dispense the selected perfume fragrance as a mist or spray through the outlet nozzle 5.

Figure 2:
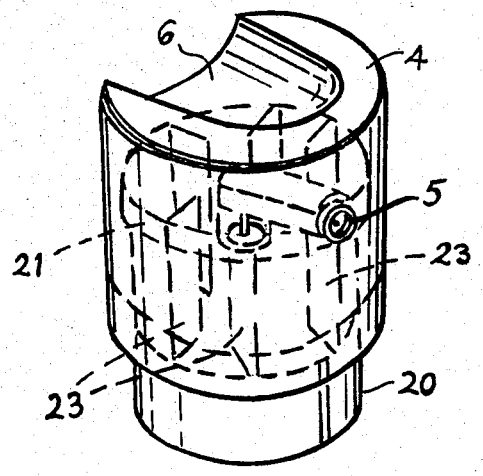
FIG. 2 is an exploded perspective view of the dispenser having parts broken away.
Figure 2:
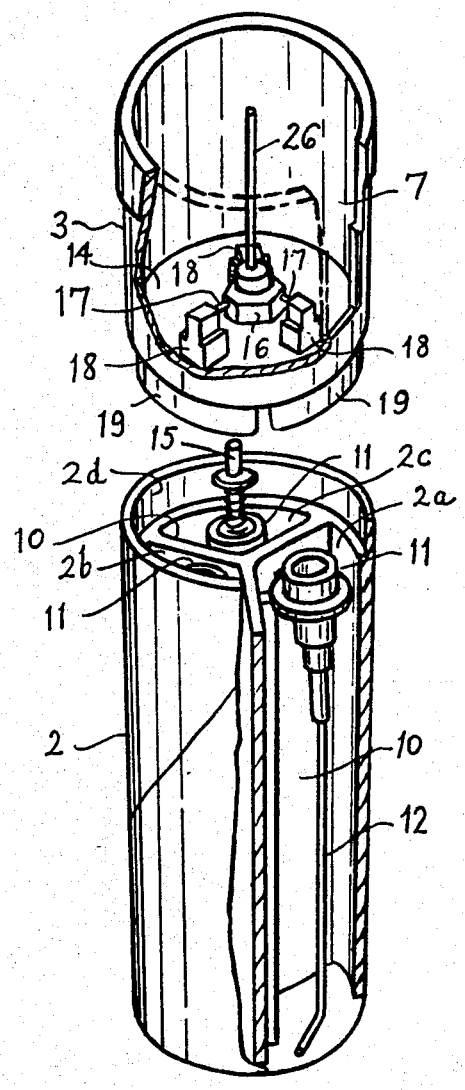

The construction and operation of the dispenser will now be described in greater detail with reference to FIGS. 2 and 3. The various parts of the dispenser are made as moldings of suitable plastics materials, such as an acetyl resin copolymer and polyethylene or polypropylene.

As can be seen, the dispenser is of generally cylindrical form and includes the cylindrical body 2 which is divided into three longitudinally extending compartments 2*a*,2*b* 2*c*, each forming a perfume container, by means of longitudinal radially direct partitions 10. The upper end of each compartment contains a valve housing 11 seated on locating projections (not shown) within the compartment and from which extends a tube 12 whose lower end reaches to the bottom of the compartment in order to enable the egress of liquid perfume essence from that compartment when desired.

The cylindrical body extends above the upper end of the compartments to form an upstanding rim 2*d* which receives and surrounds the lower end of the mid-part 3. This generally cylindrical mid-part is provided with a peripheral slot 7 forming the aperture mentioned above as well as with three holes 13 in its base 14, through which project the outlet tubes 15 of valve members (to be described) located in the valve housings 11. The mid-part 3 also accommodates a central mixing chamber 16 from which radially extend three equiangularly spaced flexible tubes 17 which are each connected at their outer end to a respective union member 18 which also fits over the upper end of the outlet tube 15 from the associated container. The tubes 17 must be flexible to allow movement of any one union 18 relative to the others as a valve member is actuated.

Figure 2A:
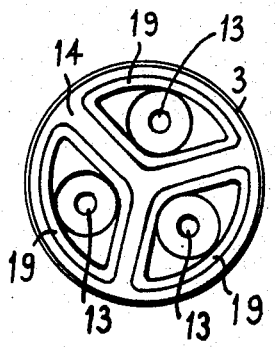
FIG. 2*a* shows the underneath of the mid-part of the dispenser.

The underside of the base 14 is formed with segment shaped projections 19 (as shown in FIG. 2*a*) which are a close fit within the correspondingly shaped upper ends of the compartments 2*a*,2*b*, 2*c* and which also serve to locate the upper rim of the valve housings 11. Since these projections 19 serve to seal the compartments forming the liquid perfume essence containers in a leak proof manner, an effective and reliable bond must be formed between the parts and this may be achieved by ultrasonic welding.

The cylindrical cap assembly 4 is provided with an inner cylindrical skirt member 20 which is a snap fit within the cap by means of a flange 21 at its upper end engaging over a shallow bead (not shown) within the cap. The flange 21 includes an aperture 21*a* leading to a passage 22 which terminates at an axial boss 22*a* within the underside of the skirt member. When the skirt member is assembled to the cap 4, the aperture therein is aligned with an aperture in the cap and the stem 5*a* of the outlet nozzle 5 is passed through the apertures and is a push fit within the passage 22 so that the nozzle 5 is located within the aperture in the cap 4 substantially flush with the outer surface of the cap.

The underside of the skirt member is also provided with a plurality of radially directed webs 23 projecting inwardly and which form actuating members whose lower edge can engage with the union members 18 to depress the latter and cause opening of the valve members located in the valve housing 11. Six such webs 23 are provided in this embodiment and are so spaced around the inner periphery of the skirt member 20 that the rotation of the cap assembly 4 to any of a plurality of predetermined positions defined by the letters A to G appearing in the aperture 7 positions a different one or combination of the actuating members 23 to engage with one or more of the union members 18.

Figure 3:
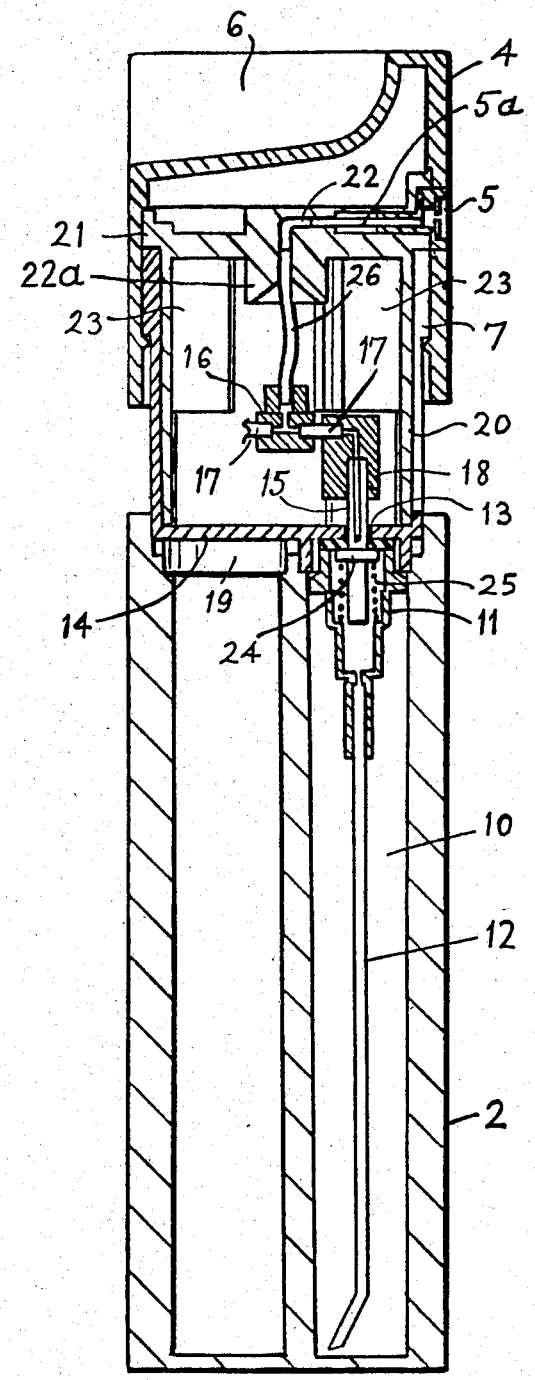
FIG. 3 is a longitudinal sectional view of the dispenser in the assembled condition.

As can be seen from FIG. 3, when the cap assembly 4 is fitted to the mid-part 3, the latter is received within the annular gap between the inside of the cap and the outside of the skirt member 20. The letters A to G are carried on the lower part of the outer surface of the skirt member and are positioned so as to appear in the aperture 7 as the cap assembly is rotated, as mentioned above. The cap assembly 4 is locked on to the mid-part 3 by the snap action of interengaging beads (not shown) on the two parts.

The valve members located in the valve housings 11 each comprise a valve body 24 including the outlet tube 15 and having a flange engaging with a spring 25 which normally holds the valve member closed. Pressure on a union member 18 depresses the valve body 24 against the spring 25 to allow liquid perfume essence under pressure within the container to be ejected through the outlet tube 15 and from thence to the mixing chamber 16.

The outlet from the mixing chamber 16 is connected to the passage 22 and outlet nozzle 5 via a resilient tube 26 which fits within the boss 23. The tube 26 is dimensioned such that it is bowed when the cap assembly 4 is depressed and it thereby acts as a resilient member to return the cap assembly to its initial position when finger pressure on the cap assembly is released.

The dispenser as described incorporates the three containers 2*a*,2*b* and 2*c* each containing a liquid perfume essence of a different fragrance which can be selectively dispensed from the dispenser. Also, any combination of the three basic essences can be dispensed, thereby giving an overall choice of seven different perfume fragrances which can be obtained from the dispenser.

The manner in which the dispenser operates to achieve this result will now be described. Firstly, as described above, the user rotates the cap assembly 4 so as to bring opposite the aperture 7 that one of the letters A to G which correspond to the selected fragrance, which may be one of the basic perfume essences or a combination of such essences. However, let it be assumed that this is the perfume essence from container 2*b*. The rotation of the cap assembly to this position will bring the actuating member 23 corresponding to this selected fragrance over the union member 18 connected to the outlet tube 15 of the pressure valve of container 2*b*. In this position, the remaining members 23 will not be located over either of the other union members 18. When the cap assembly 4 is depressed against the action of the resilient tube 26, the operative member 23 will bear down on the union member thereby depressing the pressure valve of container 2*b* to allow the perfume essence therein to be released through the tube 15, the mixing chamber 16 and outlet passage 22 and ejected from the nozzle 5 of the dispenser as a spray or mist. When the cap assembly is released, the pressure on the outlet valve of container 2*b* ceases and delivery of the perfume essence stops. If the cap assembly is now rotated to select another fragrance, e.g. that corresponding to the combination of the essences in containers 2*a* and 2*b*, the actuating members 23 corresponding to this selection are brought over the union members 18 connected to the outlet valves of the containers 2*a* and 2*b*. When the cap assembly 4 is depressed, these union members will be depressed to operate the valves of these containers to release the perfume essences therefrom into the mixing chamber 16 where they will combine and pass through the outlet passage 22 to the outlet nozzle 5 of the dispenser. Similarly, rotation of the cap assembly to any of the other positions causes operation of the outlet valve of each selected container either alone or in combination to dispense the selected fragrance from the dispenser. As soon as the pressure on the cap assembly 4 is released, the outlet valve of the container or containers which have been operative is automatically closed and the union members 18 are returned to their normal position.

Where essences from two or more containers are mixed, since they are released into the mixing chamber at the same time, the fragrance resulting from the combination of these essences is virtually consistent. It will of course be appreciated that the three basic essences in the containers 2*a*,2*b* and 2*c* must have fragrances which when combined together also produce acceptable perfume fragrances.

In a modification, the nozzle 5 may be molded integrally with the inner cylindrical skirt member 20.

I claim:

1. A perfume dispenser having means for separately storing a plurality of liquid perfumes each of a different fragrance, a selector device which enables any one liquid perfume or any combination of liquid perfumes to be selected for dispensing through an outlet of the dispenser and an actuating means operable to cause the release of a quantity of the selected liquid perfume or perfumes into a mixing chamber and from said chamber to said outlet, wherein said dispenser is provided with a body which is divided internally into a plurality of compartments each of which forms a store for containing a different liquid perfume under pressure, said actuating means includes a depressable cap which also forms the selector device and which is mounted on and rotatable relative to said body to different predetermined dispensing positions, and which carries an outlet nozzle through which the selected perfume or combination of perfumes is dispensed and a tubular member of resilient material is provided to conduct the selected perfume or combination of perfumes from said mixing chamber to said outlet nozzle, said tubular member also providing a resilient force against which the cap is depressed to actuate the dispenser to dispense said selected perfume or mixture of perfumes from said outlet nozzle, and in which said depressable cap is adapted to fit over an adjacent part of the body of the dispenser and an inner skirt is located coaxially within said cap and wherein projections are located within said inner skirt, one or more of said projections being operable for each predetermined dispensing position of the cap to actuate an outlet valve of a perfume store, dependent upon the selection made, so as to release one or more liquid perfumes via the mixing chamber as a spray or mist from the outlet nozzle.

2. A perfume dispenser as claimed in claim 1, in which the mixing chamber is located below the cap and is connected by a separate flexible tube to the outlet valve of each of the perfume stores and said mixing chamber is also connected to said outlet nozzle through said tubular member of resilient material, and in which the connection between each flexible tube and the outlet valve of the associated perfume store is effected by means of a union member attached both to the adjacent end of the flexible tube and the the outlet valve and which can be engaged by one of said projections, depending upon the angular position of said cap, so that the outlet valve is opened upon depression of the cap.

3. A perfume dispenser as claimed in claim 1, in which markings representing the different perfume fragrances which can be dispensed are provided on one of said rotatable cap and the body of the dispenser and a reference is provided on the other of said parts in order to identify the different predetermined portions of said cap representing the different perfume fragrances which may be dispensed.

4. A perfume dispenser as claimed in claim 1, comprising a cylindrical body divided into longitudinally extending compartments each of which forms a perfume store and is provided with a pressure operated outlet valve, a mid part secured to said cylindrical body and including the mixing chamber and connections from said mixing chamber to said pressure operated outlet valves and wherein said depressable cap fits over said mid part.

5. A perfume dispenser having means for separately storing a plurality of liquid perfumes each of a different fragrance, a selector device which enables any one liquid perfume or any combination of liquid perfumes to be selected for dispensing through an outlet of the dispenser and an actuating means operable to cause the release of a quantity of the selected liquid perfume or perfumes into a mixing chamber and from said chamber to said outlet, wherein said dispenser is provided with a body which is divided internally into a plurality of compartments each of which forms a perfume store for containing a different liquid perfume under pressure, said actuating means includes a depressable cap which also forms the selector device and which is mounted on and rotatable relative to said body to different predetermined dispensing positions and which carries an outlet nozzle through which the selected perfume or combination of perfumes is dispensed, and a tubular member of resilient material provided to conduct the selected perfume or combination of perfumes from said mixing chamber to said outlet nozzle, said tubular member also providing a resilient force against which the cap is depressed to actuate the dispenser to dispense said selected perfume or mixture of perfumes from said outlet nozzle, said depressable cap comprising a series of projections located within an inner skirt of said cap, one or more of said projections being operable for each predetermined dispensing position of the cap to actuate an outlet valve of a perfume store, dependent upon the selection made, so as to release one or more liquid perfumes via the mixing chamber as a spray or mist from the outlet nozzle, and in which said inner skirt projects beyond said cap and the projecting region of said inner skirt carries markings indicative of the different perfume selections which can be made and which become visible through an aperture in the adjacent body of the dispenser as the cap is rotated to different positions.

6. A perfume dispenser as claimed in claim 5, in which the mixing chamber is located below the cap and is connected by a separate flexible tube to the outlet valve of each of the perfume stores and said mixing chamber is also connected to said outlet nozzle through said tubular member of reslient material, and in which the connection between each flexible tube and the outlet valve of the associated perfume store is effected by means of a union member attached both to the adjacent end of the flexible tube and to the outlet valve and which can be engaged by one of said projections, depending upon the angular position of said cap, so that the outlet valve is opened upon depression of the cap.

* * * * *